US010712051B2

(12) United States Patent
Babucke

(10) Patent No.: US 10,712,051 B2
(45) Date of Patent: Jul. 14, 2020

(54) REFRIGERATION APPLIANCE WITH MULTIPLE TEMPERATURE ZONES

(71) Applicant: BSH HAUSGERAETE GMBH, Munich (DE)

(72) Inventor: Andreas Babucke, Heidenheim (DE)

(73) Assignee: BSH Hausgeraete GmbH, Munich (DE)

( * ) Notice: Subject to any disclaimer, the term of this patent is extended or adjusted under 35 U.S.C. 154(b) by 135 days.

(21) Appl. No.: 16/106,202

(22) Filed: Aug. 21, 2018

(65) Prior Publication Data

US 2019/0072298 A1 Mar. 7, 2019

(30) Foreign Application Priority Data

Sep. 4, 2017 (DE) ..... 10 2017 215 488

(51) Int. Cl.

| | |
|---|---|
| ***F25B 5/02*** | (2006.01) |
| ***F25B 43/00*** | (2006.01) |
| ***F25D 11/02*** | (2006.01) |
| ***F25D 17/06*** | (2006.01) |
| *F25D 31/00* | (2006.01) |
| *F25B 5/00* | (2006.01) |

(52) U.S. Cl.

CPC ..... *F25B 5/02* (2013.01); *F25B 43/003* (2013.01); *F25D 11/022* (2013.01); *F25D 17/065* (2013.01); *F25B 5/00* (2013.01); *F25B 2400/02* (2013.01); *F25B 2400/23* (2013.01); *F25D 31/005* (2013.01); *F25D 2317/061* (2013.01)

(58) Field of Classification Search

CPC .. F25B 5/02; F25B 43/003; F25B 5/00; F25B 2400/02; F25B 2400/23; F25B 43/00; F25B 41/00; F25B 39/00; F25B 1/00; F25D 17/065; F25D 11/022; F25D 31/005; F25D 2317/061

See application file for complete search history.

(56) References Cited

U.S. PATENT DOCUMENTS

| | | | | |
|---|---|---|---|---|
| 2017/0248348 | A1* | 8/2017 | Kim | F25D 17/08 |
| 2017/0268808 | A1* | 9/2017 | Rahhal | F25B 1/00 |
| 2018/0156498 | A1* | 6/2018 | Matsumoto | F25B 39/028 |
| 2018/0258922 | A1* | 9/2018 | Ascani | F04B 39/123 |

* cited by examiner

*Primary Examiner* — Emmanuel E Duke
(74) *Attorney, Agent, or Firm* — Laurence A. Greenberg; Werner H. Stemer; Ralph E. Locher

(57) ABSTRACT

A refrigeration appliance includes first and second temperature zones and a refrigerant circuit having first and second parallel branches. The first branch has a controllable first restriction point and a first heat exchanger for setting a temperature of the first temperature zone, and the second branch has a second restriction point and a second heat exchanger for setting a temperature of the second temperature zone. A branching point, at which the refrigerant circuit splits into the two branches, is configured as a separator for separating gas and liquid and the second branch is connected to a liquid outlet of the separator.

14 Claims, 1 Drawing Sheet

REFRIGERATION APPLIANCE WITH MULTIPLE TEMPERATURE ZONES

CROSS-REFERENCE TO RELATED APPLICATION

This application claims the priority, under 35 U.S.C. § 119, of German Patent application DE 10 2017 215 488.8, filed Sep. 4, 2017; the prior application is herewith incorporated by reference in its entirety.

BACKGROUND OF THE INVENTION

Field of the Invention

The present invention relates to a refrigeration appliance, in particular a domestic refrigeration appliance, including at least two temperature zones and a refrigerant circuit having a heat exchanger and a restriction point upstream of the heat exchanger for each of the temperature zones, in which at least one of the restriction points can be controlled. The controllable restriction point allows the pressure of the refrigerant within the heat exchanger to be changed within broad limits. If the set pressure is lower than the vapor pressure of the refrigerant at ambient temperature, the heat exchanger acts as an evaporator, cooling the associated temperature zone. However, if the controllable restriction point is open so wide that the pressure in the downstream heat exchanger exceeds the vapor pressure of the refrigerant at ambient temperature, refrigerant vapor in the heat exchanger can condense and the associated temperature zone is heated.

If one of two heat exchangers disposed in parallel branches in the refrigerant circuit is to heat and the other is to cool, the refrigerant circuit must carry both vapor and liquid refrigerant upstream of the two heat exchangers. Refrigerant vapor reaching the branch of the cooling heat exchanger does not contribute to the cooling capacity due to the absence of a phase change, but work must still be expended to push the refrigerant vapor through the restriction point upstream of the heat exchanger.

SUMMARY OF THE INVENTION

It is accordingly an object of the invention to provide a refrigeration appliance with multiple temperature zones, which overcomes the hereinafore-mentioned disadvantages of the heretofore-known appliances of this general type and which has improved efficiency.

With the foregoing and other objects in view there is provided, in accordance with the invention, a refrigeration appliance, in particular a domestic refrigeration appliance, including a first and a second temperature zone, a refrigerant circuit having first and second parallel branches, the first branch having a controllable first restriction point and a first heat exchanger for setting a temperature of the first temperature zone and the second branch having a second restriction point and a second heat exchanger for setting a temperature of the second temperature zone, a branching point, at which the refrigerant circuit splits into the two branches, is configured as a separator for separating gas and liquid and the second branch is connected to a liquid outlet of the separator.

This allows refrigerant vapor, which has reached the branching point, to be fed specifically to the first heat exchanger and to condense there while emitting heat, while a needless discharge of vapor by way of the second evaporator is prevented.

It should be possible to set the controllable first restriction point for a smaller pressure drop than that of the second restriction point.

In order to be able to maintain the high pressure required for condensation in the first heat exchanger, a third restriction point should be provided in the first branch downstream of the first heat exchanger. In order to ensure that any adjustment of the first restriction point does not necessarily also change the throughput of the first branch, the third restriction point should also be adjustable.

The separator should have a hollow space, where an inlet, the liquid outlet and a gas outlet are formed.

In order to allow a separation of gas and liquid by gravity, the liquid outlet should be at a lower point in the hollow space than the gas outlet.

The height difference should be tailored to the fill level of the refrigerant circuit so that, if the first restriction point is partially open so that refrigerant backs up there, liquid refrigerant can overflow into the gas outlet and reach the first heat exchanger. It is only in this way that the first heat exchanger can also be used to cool the first temperature zone.

In order to prevent liquid from dripping into the gas outlet, the gas outlet should not have a cross-sectional surface that is open at the top.

The separator can expediently be used to hold drying material used in a manner known per se to absorb moisture residues from the refrigerant.

The drying material is preferably located in the hollow space, between the inlet and the two outlets.

The inlet in this case should be disposed above and at least the liquid outlet should be disposed below the drying material, in order to ensure an intensive interaction of the drying material at least with the liquid phase of the refrigerant.

A condenser should be connected upstream of the branching point in the refrigerant circuit, in order to allow an adequate supply to the second branch.

In order to use liquid refrigerant leaving the first heat exchanger, an evaporator should be connected downstream of it in the refrigerant circuit. The evaporator is preferably located downstream of a merging point, at which the branches come together.

A fourth restriction point can be provided in the second branch downstream of the first heat exchanger, so that a higher evaporation temperature can be set therein than in an evaporator located further downstream.

A speed-regulated compressor allows uninterrupted compressor operation and thus the continued maintenance of the pressure set in the heat exchangers.

Other features which are considered as characteristic for the invention are set forth in the appended claims.

Although the invention is illustrated and described herein as embodied in a refrigeration appliance with multiple temperature zones, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
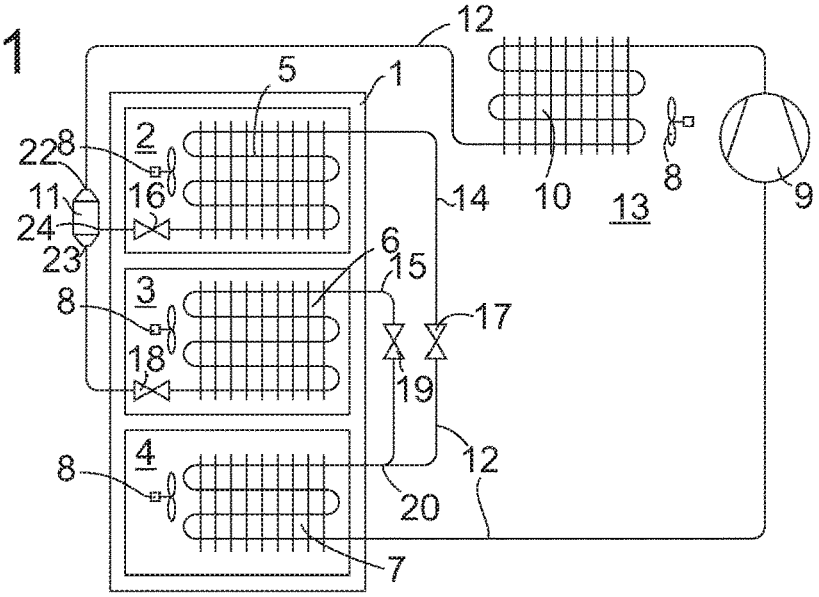
FIG. 1 is a schematic diagram of a refrigeration appliance according to the invention.

Referring now to the figures of the drawings in detail and first, particularly, to FIG. 1 thereof, there is seen a schematic diagram of a domestic refrigeration appliance with a heat-insulating housing 1, in which multiple temperature zones 2, 3, 4, each in the form of a compartment that can be closed by a door, are formed. The figure shows three such temperature zones but more can be provided.

Each temperature zone 2, 3, 4 is assigned a heat exchanger 5, 6, 7, e.g. a plate heat exchanger of the roll-bond or tube-on-sheet type. Such a heat exchanger can be mounted in the interior of the compartment of the temperature zone 2, 3, 4 and exposed in front of a wall or in the wall, between a heat insulation layer and an inner container delimiting the compartment.

Alternatively the temperature zones 2, 3, 4 can also be subdivided into a storage compartment and a heat exchanger chamber, with a fan 8 driving the exchange of air between the storage compartment and the heat exchanger chamber.

The heat exchangers 5, 6, 7, together with a speed-regulated compressor 9, a condenser 10, a separator 11, multiple restriction points and a refrigerant line 12 connecting them, form a refrigerant circuit 13. A high-pressure segment of the refrigerant line 12 runs from the compressor 9 by way of the condenser 10 to the separator 11. The high-pressure segment splits into two branches 14, 15 at the separator 11. A restriction point 16, the heat exchanger 5 and a restriction point 17 are connected in series at the branch 14. A restriction point 18, the heat exchanger 6 and a restriction point 19 are connected in series at the branch 15. The branches 14, 15 come together again at a merging point 20. A low-pressure segment of the refrigerant line 12 extends from the merging point 20 by way of the heat exchanger 7 back to the compressor 9.

The restriction points 16-19 keep the heat exchangers 5, 6 at a higher pressure than the heat exchanger 7. Since the lowest evaporation temperature thus prevails in the heat exchanger 7, the temperature zone 4 is typically used as a freezer zone. The permitted flow through the restriction points 18, 19 is selected in such a way that the evaporation temperature that results in the heat exchanger 6 is significantly higher than that of the heat exchanger 7 and the temperature zone 3 can be used as a standard or keep-fresh zone.

The pressure drop at the restriction point 16 can be set between values that allow the temperature zone 2 also to be used as a standard or keep-fresh zone and almost zero. If the pressures in the condenser 10 and heat exchanger 5 are practically identical, the refrigerant does not only condense in the condenser 9 but also in the heat exchanger 5 and this heats the temperature zone 2 to a temperature above ambient temperature.

A necessary consequence of condensation in the heat exchanger 5 is that not only liquid refrigerant but also vapor leaves the condenser 9 and presses forward in the refrigerant line. If the vapor entered the branch 15, it would expand again at the restriction point 18 and the work performed by the compressor 9 on the vapor would then be lost without any useful cooling effect. Conversely liquid refrigerant, passing from the condenser 9 into the branch 14, could no longer release any significant heat at its heat exchanger 5 but would also no longer be available to cool the temperature zone 3. The separator 11 ensures that the refrigerant that has already condensed in the condenser 9 is fed selectively to the heat exchanger 6, so that the latter benefits from the heat emitting capacity of the condenser 9 without loss, while the vapor is fed into the heat exchanger 5 and its heating capacity is thus not tangibly reduced by the upstream condenser 9.

Figure 2:
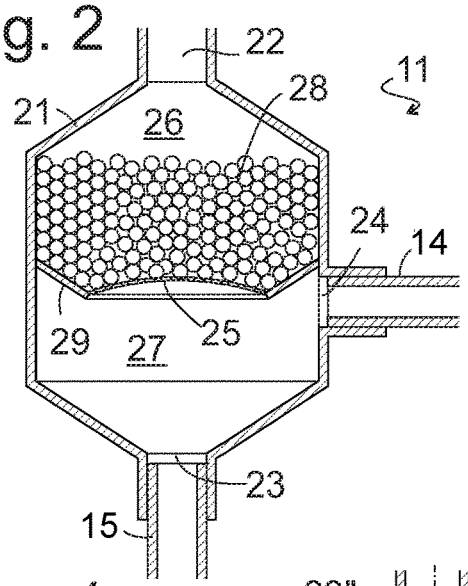
FIG. 2 is an axial sectional view through a first embodiment of a separator of the refrigeration appliance.

FIG. 2 shows an axial section through the separator 11 according to a first embodiment. A housing 21 is formed by a preferably metal pipe, which tapers at its ends to form an inlet 22 for a phase mixture originating from the condenser 9 and an outlet 23 for a liquid refrigerant. One end of the branch 15 is soldered into the outlet 23. An opening is drilled into the housing 21 about halfway up and enclosed by a sleeve to form an outlet 24 for refrigerant vapor. One end of the branch 14 is inserted into the outlet 24.

The interior of the housing 21 is subdivided by a screen or grid 25 into an upper and a lower chamber 26, 27. The inlet 22 opens into the upper chamber 26, which is filled with a drying material 28. The outlets 23, 24 leave the lower chamber 27. The inflowing phase mixture therefore first passes through the drying material 28 in the separator 11, where moisture carried in the refrigerant that was originally adsorbed when the refrigerant circuit was assembled on the insides of the refrigerant line 12 and the heat exchangers 5, 6, 7 is absorbed and removed from the circuit. The granular drying material 28 and the grid 25 can at the same time also form a filter for trapping particulate contaminants from the refrigerant flow.

Liquid refrigerant drips from the grid 25 to the bottom of the chamber 27 and leaves the separator by way of the outlet 23 exiting from there. In order to keep liquid refrigerant away from the outlet 24, it may be sufficient if the latter's cross-sectional surface is open to the side or at the bottom, as shown in FIG. 2, so that nothing can drip into it. In the example shown in FIG. 2 the grid 25 is enclosed by a peripheral apron 29, the lower edge of which forms a drip edge horizontally removed from the outlet 24. This prevents liquid refrigerant from flowing down the inner wall of the housing 21 and being carried by the vapor flow into the outlet 24.

Figure 3:
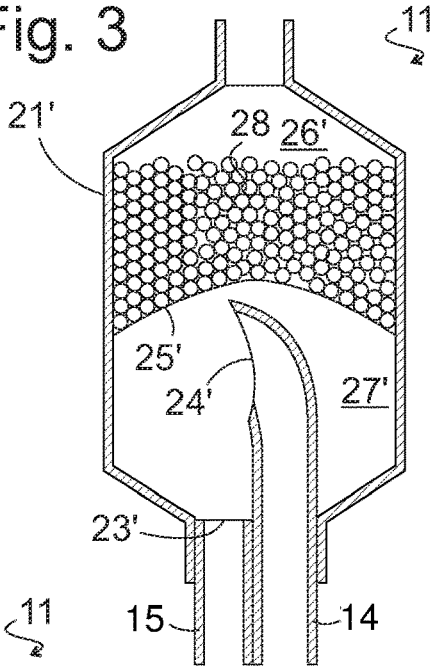
FIG. 3 is an axial sectional view through a second embodiment of the separator.

FIG. 3 shows a second embodiment of the separator 11. In this embodiment a housing 21' is also formed by a pipe with tapered ends but there is no need to drill an opening, since outlets 23', 24' for liquid and vapor are formed by ends of the branches 14, 15 inserted into a lower end of the housing 21'. The branch 15 only reaches so far into the housing 21' that the outlet 23' is located at the lowest point of its interior and liquid refrigerant can flow away by way of the outlet 23' in its entirety. The branch 14 extends further into the housing 21' so that the outlet 24' is higher than the outlet 23'.

The outlet 24' could be a straight cut pipe end that is open at the top as is shown in FIG. 3 for the outlet 23'. Small quantities of liquid refrigerant, passing to the heat exchanger 5 by way of such a pipe end, do not significantly impair its heating capacity, since they only make up a small part of its volume throughput. In order to also keep such small quantities away from the heat exchanger 5, the grid 25' over the outlet 24' could also be made locally impermeable, so that no drips form above the outlet 24', which could drip down. In the example shown in this case the end of the branch 14 is slightly bent and cut along a substantially vertical surface, to form the outlet 24'.

Figure 4:
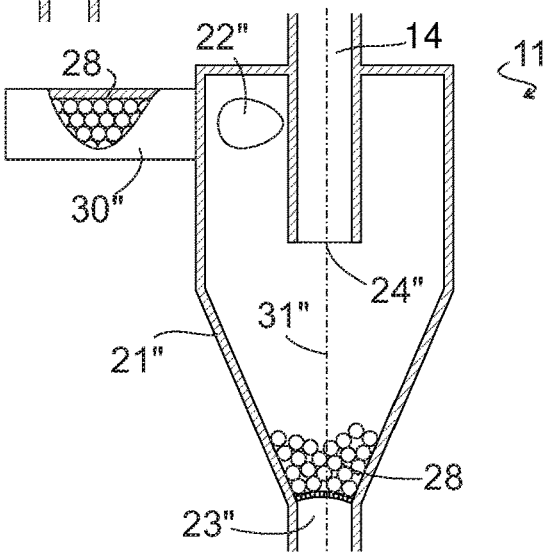
FIG. 4 is an axial sectional view through a third embodiment of the separator.

FIG. 4 shows an embodiment of the separator 11 according to the centrifugal principle. An inlet 22" in this case is formed by a pipe 30", which opens into the housing 21" and is offset orthogonally in relation to an axis 31" of the housing 21" and laterally relative to the axis 31". The offset allows the refrigerant in the housing 21" to rotate about the axis 31", so that liquid components are deposited on the housing wall and pass into the branch 15 by way of an outlet 23" at the bottom of the housing 21". The vapor leaves the housing by way of an outlet 24" at the end of the branch 14 that engages in the housing 21" from above.

The drying material 28 can be disposed in the pipe 30" or at the bottom of the housing 21". In the latter case substantially only the liquid phase of the refrigerant comes into contact with the drying material but this does not significantly impair the effect of the drying material, since the greater density of the liquid means that water molecules there are much more likely to come into contact with the drying material and be absorbed than in the vapor phase.

Refrigerant that has condensed in the heat exchanger 5 passes by way of the restriction point 17 into the heat exchanger 7 and evaporates again there.

The following is a summary list of reference numerals and the corresponding structure used in the above description of the invention:

1 Housing
2 Temperature zone
3 Temperature zone
4 Temperature zone
6 Heat exchanger
7 Heat exchanger
8 Fan
9 Compressor
10 Condenser
11 Separator
12 Refrigerant line
13 Refrigerant circuit
14 Branch
15 Branch
16 Restriction point
17 Restriction point
18 Restriction point
19 Restriction point
20 Merging point
21 Housing
22 Inlet
23 Outlet
24 Outlet
25 Grid
26 Upper chamber
27 Lower chamber
28 Drying material
29 Apron
30 Pipe
31 Axis

The invention claimed is:

1. A refrigeration appliance or domestic refrigeration appliance, comprising: first and second temperature zones; a refrigerant circuit having a branching point at which said refrigerant circuit splits into first and second parallel branches, said branching point being configured as a separator for separating gas and liquid, said separator having a liquid outlet and a gas outlet; said first branch having a controllable first restriction point and a first heat exchanger for setting a temperature of said first temperature zone, said first branch being connected to said gas outlet of said separator; and said second branch having a second restriction point and a second heat exchanger for setting a temperature of said second temperature zone, said second branch being connected to said liquid outlet of said separator.

2. The refrigeration appliance according to claim 1, wherein said controllable first restriction point is configured to be set for a pressure drop being smaller than a pressure drop of said second restriction point.

3. The refrigeration appliance according to claim 1, wherein said first branch has a controllable third restriction point downstream of said first heat exchanger.

4. The refrigeration appliance according to claim 3, which further comprises a fourth restriction point disposed in said second branch downstream of said second heat exchanger.

5. The refrigeration appliance according to claim 1, wherein said separator has a hollow space, and an inlet, said liquid outlet and said gas outlet are formed at said hollow space.

6. The refrigeration appliance according to claim 5, wherein said liquid outlet is located lower than said gas outlet.

7. The refrigeration appliance according to claim 6, wherein a height difference between said liquid outlet and said gas outlet is adjusted to a fill level of said refrigerant circuit, permitting liquid refrigerant to overflow into said gas outlet if refrigerant backs up at said first restriction point.

8. The refrigeration appliance according to claim 5, wherein said gas outlet does not have an upwardly open cross-sectional surface.

9. The refrigeration appliance according to claim 5, wherein said separator contains a drying material.

10. The refrigeration appliance according to claim 9, wherein said drying material is accommodated in said hollow space.

11. The refrigeration appliance according to claim 10, wherein said inlet is disposed above said drying material and at least said liquid outlet is disposed below said drying material.

12. The refrigeration appliance according to claim 1, which further comprises a condenser connected upstream of said separator in said refrigerant circuit.

13. The refrigeration appliance according to claim 1, wherein said refrigerant circuit has a merging point at which said branches come together and an evaporator connected downstream of said merging point.

14. The refrigeration appliance according to claim 1, wherein said refrigerant circuit includes a speed-regulated compressor.

* * * * *